US010412507B2

(12) United States Patent
Fischer

(10) Patent No.: US 10,412,507 B2
(45) Date of Patent: Sep. 10, 2019

(54) METHOD FOR OPERATING A HEARING DEVICE, HEARING DEVICE AND BINAURAL HEARING DEVICE SYSTEM

(71) Applicant: SIVANTOS PTE. LTD., Singapore (SG)

(72) Inventor: Eghart Fischer, Schwabach (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 16/110,339

(22) Filed: Aug. 23, 2018

(65) Prior Publication Data

US 2019/0075405 A1 Mar. 7, 2019

(30) Foreign Application Priority Data

Sep. 7, 2017 (DE) ..... 10 2017 215 823

(51) Int. Cl.
*H04R 25/00* (2006.01)

(52) U.S. Cl.
CPC ..... *H04R 25/407* (2013.01); *H04R 25/405* (2013.01); *H04R 25/453* (2013.01); *H04R 25/505* (2013.01); *H04R 25/552* (2013.01); *H04R 2225/43* (2013.01); *H04R 2430/20* (2013.01); *H04R 2430/21* (2013.01); *H04R 2430/23* (2013.01)

(58) Field of Classification Search
USPC ..... 381/23.1, 26, 58, 60, 72, 312, 328, 330, 381/348, 380, 381
See application file for complete search history.

(56) References Cited

U.S. PATENT DOCUMENTS

| | | | | |
|---|---|---|---|---|
| 6,865,275 | B1 * | 3/2005 | Roeck | H04R 25/407 381/122 |
| 9,253,581 | B2 | 2/2016 | Aubreville et al. | |
| 2008/0205659 | A1 | 8/2008 | Fischer et al. | |
| 2012/0189147 | A1 | 7/2012 | Terada et al. | |
| 2014/0198934 | A1 | 7/2014 | Recker | |

FOREIGN PATENT DOCUMENTS

| | | | |
|---|---|---|---|
| DE | 102007008738 | A1 | 8/2008 |
| DE | 102013207149 | A1 | 11/2014 |
| EP | 2 961 199 | * | 1/2014 |
| EP | 2961199 | A1 | 12/2015 |

* cited by examiner

*Primary Examiner* — Yosef K Laekemariam
(74) *Attorney, Agent, or Firm* — Laurence A. Greenberg; Werner H. Stemer; Ralph E. Locher

(57) ABSTRACT

A method for operating a hearing device includes generating first and second input signals from a sound signal by using respective first and second input transducers, providing a first angle and an angular range and, with respect to frequency bands, based on the first and second input signals and first angle, forming an attenuation directional signal having relative attenuation at least for a second angle in the angular range about the first angle and thereby setting and an overlay parameter. A gain directional signal is formed based on the first and second input signals and the overlay parameter and/or second angle, having relative gain for the second angle. An angled directional signal is generated from the attenuation directional signal and the gain directional signal. An output signal is generated based on the angled directional signal. A hearing device and a binaural hearing device system are also provided.

9 Claims, 1 Drawing Sheet

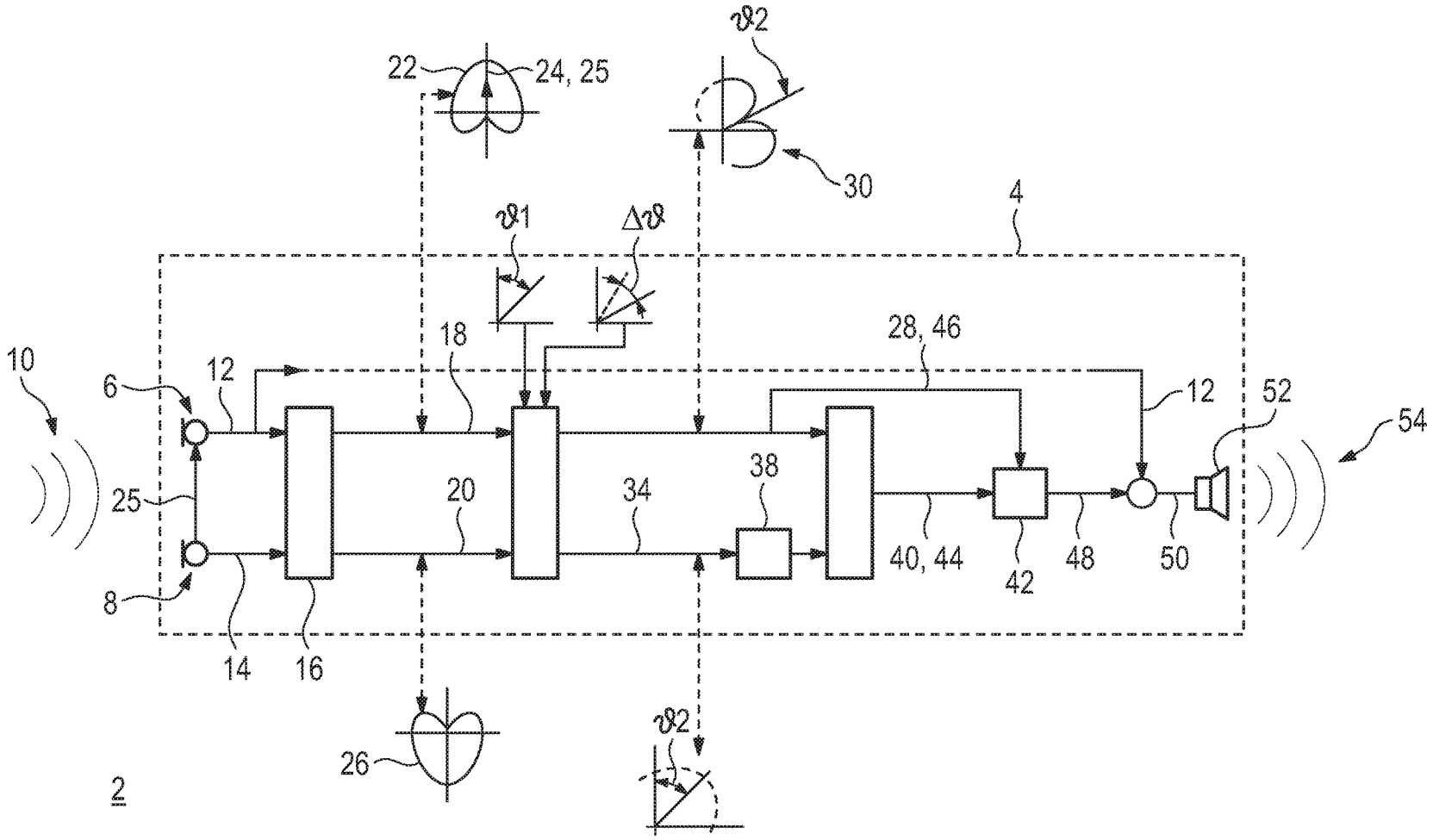
54
52
50
12
48
42
4
28, 46
40, 44
30
38
34
24, 25
22
18
20
16
26
12
14
6
25
8
10
2

METHOD FOR OPERATING A HEARING DEVICE, HEARING DEVICE AND BINAURAL HEARING DEVICE SYSTEM

CROSS-REFERENCE TO RELATED APPLICATION

This application claims the priority, under 35 U.S.C. § 119, of German Patent Application DE 10 2017 215 823.9, filed Sep. 7, 2017; the prior application is herewith incorporated by reference in its entirety.

BACKGROUND OF THE INVENTION

Field of the Invention

The invention relates to a method for operating a hearing device in which a first input signal is generated from a sound signal by a first input transducer, a second input signal is generated from the sound signal by a second input transducer, a gain directional signal is formed based on the first input signal and the second input signal, and an output signal is generated from the gain directional signal.

In a hearing device, a sound signal from the environment is converted into corresponding electrical signals by one or more input transducers, and is (among other things) subjected to frequency band-dependent amplification to correct for the hearing loss of the user of the hearing device. The amplified signal that has been amplified in that way is converted by an output transducer into an output sound signal, which is transmitted to the user's ear. Two basic tasks of the hearing device are to present the user with a sound pattern tailored to the user's individual requirements in terms of hearing loss, in which potentially useful signals are masked as little as possible by noise, so as to yield the best possible signal to noise ratio (SNR).

For a hearing device with at least two input transducers, that task may be achieved by the—potentially frequency-band-specific—use of directional microphones on the corresponding input signals. For that purpose, it is assumed that useful signals such as for example speech or music mostly come to the user from a clearly defined direction while many types of noise or interference come from a comparatively wide angular range, in such a way that it is not possible to assign a clear direction for the sound source.

Moreover, in most implementations of directional microphones in hearing devices, it is assumed that the user's line of sight is instinctively aligned to the source of a useful signal, so that in order to suppress interference, the directional microphone should be oriented substantially in the user's frontal direction. However, in addition to the desired noise suppression, that sometimes also leads to an unnatural perception of the environment. Sound events that occur away from the preferred direction of the directional microphone are hidden by the noise suppression, regardless of whether they are required for realistically reproducing the surrounding situation. Accordingly, localizing such sound events is often not satisfactorily possible for the user of the hearing device, which may impair the user's overall perception of the environment.

Moreover, existing directional microphone algorithms do not sufficiently take into account the individual anatomical properties and the resulting limitations that arise for example with respect to the directional field of a real ear. For example, due to the shape of the pinna, a human ear has a markedly reduced sensitivity to sound signals towards the back, while the shape of the concha and auditory meatus cause the direction of maximum sensitivity to be oriented broadly obliquely forward, with the exact maximum varying depending on individual anatomy. Circumstances such as those should be taken into consideration for the most realistic possible auditory perception. The possibility that exists in binaural hearing device systems, to form a directional microphone from two omnidirectional signals, which are respectively generated at one ear of the user, may not sufficiently reproduce the anatomical characteristics and resulting limitations.

SUMMARY OF THE INVENTION

It is accordingly an object of the invention to provide a method for operating a hearing device, a hearing device and a binaural hearing device system, which overcome the hereinafore-mentioned disadvantages of the heretofore-known methods, devices and systems of this general type and which allow the most realistic possible spatial auditory perception, and thereby at least in principle make it possible to consider user-specific anatomical features for spatial auditory perception.

With the foregoing and other objects in view there is provided, in accordance with the invention, a method for operating a hearing device in which a first input signal is generated by a first input transducer from a sound signal, a second input signal is generated by a second input transducer from the sound signal, a first angle and an angular range are given, with respect to frequency bands, based on the first input signal, the second input signal and the first angle, an attenuation directional signal is formed which has a relative attenuation at least for a second angle in the angular range about the first angle, and an overlay parameter is set in this way, a gain directional signal is formed based on the first input signal and the second input signal as well as the overlay parameter and/or the second angle, having a relative gain for the second angle. an angled directional signal is generated from the attenuation directional signal and the gain directional signal, and an output signal is generated based on the angled directional signal. Advantageous distinct embodiments are the subject matter of the dependent claims and the following description.

Preferably, the first input signal and the second input signal each have an omnidirectional directivity. The formation of the attenuation directional signal based on the first input signal and the second input signal may in this case particularly take place in such a way that a plurality of intermediate signals each having a non-trivial directivity are initially formed from the first input signal and the second input signal, and then from these intermediate signals the attenuation directional signal is formed based on the first angle, for example by linear superposition. The same intermediate signals may be used in particular for the generating the gain directional signal (correspondingly based on the overlay parameter and/or second angle).

Alternatively, it is also conceivable that the attenuation directional signal may be formed directly by a time-delayed overlay of the first input signal with the second input signal. A comparable approach is also possible for the gain directional signal.

The first angle and the angular range may also be specified implicitly, for example by using parameters, as long as the corresponding parameters unambiguously define the first angle or angular range. If, for example, the attenuation directional signal is to be formed by superimposing intermediate signals, then the first angle may be implicitly specified by using a provisional overlay parameter a0, which corresponds to a sensitivity minimum in the first angle for the attenuation directional signal. The final overlay parameter a, which in particular corresponds to a sensitivity minimum in the second angle, may then take place by a variation of the overlay parameter, for example in the form of a minimization of the signal level, over a range Δa that exactly corresponds to the angular range.

A relative attenuation for the attenuation directional signal in the second angle, should be understood in particular to mean that at this angle the sensitivity has a substantially lower value than the global maximum of the directivity, and in particular has a local minimum. However, the condition of the local minimum may also be relaxed in such a way that this minimum may be found at least in the angular range around the first angle, as long as the sensitivity increases monotonically over the entire angular range starting from the minimum, and assumes significantly lower values than the global maximum. The relative gain of the gain directional signal at the second angle should be understood in particular as a sensitivity that is considerably increased relative to the global minimum value, and in particular an absence of local minima of sensitivity in the immediate vicinity of the second angle, i.e. for example over the predetermined angular range. In this case, the predetermined angular range may in particular include a widening of up to +/−15°, preferably up to +/−10°. In this context, the relative attenuation in the attenuation directional signal may be understood in particular as signifying that the attenuation directional signal has a significantly lower sensitivity over a solid angular range that is significantly greater than the predefined angular range, i.e., for example, in one quadrant, the attenuation directional signal has a substantially smaller sensitivity than the maximum value in the quadrant in which the second angle is located. The relative gain by using the gain directional signal may then be understood in this context to signify that the gain directional signal has a substantially greater sensitivity in the second angle than the minimum value of the sensitivity for the gain directional signal in the quadrant.

The angled directional signal may be constructed in such a way that it has a relative gain as a result of the contributions of the gain directional signal in the direction of the second angle. In this case, the attenuation directional signal, or its contributions to the angled directional signal, provides an additional degree of freedom in order to make it possible to determine a strength of the directional effect of the angled directional signal with respect to the second angle. Due to the relative attenuation of the attenuation directional signal in the direction of the second angle, which is important in relation to the global maxima of the sensitivity of the attenuation directional signal, and in the ideal case leads to complete suppression in the direction of the second angle, the sound signal component may be adjusted to the component of the attenuation directional signal in the angled directional signal having a source outside the second angle, without a significant change occurring in the second angle as a result of this adjustment that would require readjusting the gain directional signal.

The above-mentioned method steps are preferably carried out in a frequency band-specific manner in each case, and the angled directional signal should preferably be adapted frequency-band-specifically, through an output level, to the individual requirements of the user of the hearing device. However, such adaptation may also take place after additional, possibly directional noise suppression and/or after a renewed addition of omnidirectional signal contributions by frequency band.

Suitably, the attenuation directional signal is formed from the first input signal and the second input signal or from intermediate signals that are respectively derived from the first input signal and the second input signal, and to form the attenuation directional signal, the signal level is minimized over the angular range around the first angle. This means, in particular, that the first input signal and the second input signal directly, or indirectly in the case of formation from intermediate signals derived from these signals, each linearly input into the attenuation directional signal. The term "minimizing the signal level to form the attenuation directional signal" should be understood to mean that the first input signal and the second input signal, or the intermediate signals derived therefrom, are correspondingly convexly overlaid, and the overlay parameter is minimized with respect to the signal level, with the minimization taking place under the constraint that the resulting second angle for a local minimum of sensitivity should be within the predetermined angular range around the first angle. The signal resulting from this minimization is then taken as the attenuation directional signal, and the angle corresponding to the local minimum of the sensitivity for this signal is used as the second angle, together with the resulting overlay parameter, for the gain directional signal and/or further signal processing.

The formation of the attenuation directional signal based on such a minimization has the advantage that the signal components input into the angled directional signal to amplify the corresponding directivity contribute particularly little to the overall level of the angled directional signal, and thus the additional degree of freedom for the directional effect has less effect on the overall pattern of the ambient sound.

In a further advantageous development, a first directional signal and a second directional signal are formed as intermediate signals based on the first input signal and the second input signal. In this case, the first directional signal and the second directional signal are preferably each formed from a time-delayed overlaying of the first input signal and second input signal. Particularly preferred in this case is the respective time delay given by the sound path from the first input transducer to the second input transducer or vice versa, so that the first directional signal has a cardioid-shaped directivity with respect to the axis defined by the first input transducer and the second input transducer, and the second directional signal correspondingly has an anti-cardioid-shaped directional characteristic.

It is expedient that this attenuation directional signal is formed from the first directional signal and the second directional signal based on the first angle and angular range, and/or that the gain directional signal is formed from the first directional signal and the second directional signal based on the overlay parameter and/or the second angle.

The use of these directional signals as intermediate signals has the advantage that no variations of the time parameters have to be made to form the attenuation directional signal and gain directional signal, and particularly to estimate the corresponding angle-dependent attenuation or gain. Rather, variation may be carried out based on an overlay parameter. As a result, it is not necessary for any delays with variations to be realized that could be below one sampling period in the individual case. Rather, only algebraic operations are required.

Particularly preferably, a notch filter directional signal is formed as the attenuation directional signal. This should be understood as referring to a signal with a directional characteristic having a sensitivity in at least one direction that is reduced by at least six dB, preferably by several tens of dB, from the global maximum sensitivity value, with the shape of the directivity corresponding to a notch at the minimum value. Preferably, the minimum, i.e. the "notch," is located at the second angle $\vartheta 2$. By using a notch filter as the attenuation directional signal, the following angle-dependent method steps may be controlled with particular ease, because the signal contributions of the attenuation directing signal at the second angle may be neglected.

It is preferred that the angled directional signal is formed by overlaying, and in particularly linearly superposing, the attenuation directional signal and the gain directional signal. In particular, in this case the angled directional signal may be formed by an overlay of the form $$S=L+c\cdot N$$

where S is the angled directional signal, L is the gain directional signal, N is the attenuation directional signal, and c is a linear factor. The greater c is, the stronger the directional effect of the angled signal.

Expediently, the signal level in this case is minimized for producing the angled directional signal. In this way, it may be achieved that the contributions of the attenuation directional signal, which represent spatial directions away from the desired preferred direction of the second angle, are input into the angled directional signal to the smallest possible extent.

It has further proven advantageous that for generating the output signal, directional noise suppression is performed, and the angled directional signal is specified as a useful signal and the attenuation directional signal is specified as an interference signal. Generally, directional noise suppression is an algorithm used to improve SNR in many hearing devices. In this case, a directed useful signal is assumed, and a reinforcing directional signal is oriented in this direction. The other spatial directions are attenuated, because it is assumed that the noise component is higher in these directions. In the context of the present method, the gain directional signal or attenuation directional signal that is present regardless may be used for gain or attenuation. This is particularly advantageous if the attenuation directional signal has already been generated by minimizing the overall signal level over the predetermined angular range, because in this case it should be assumed that the useful signal component in the attenuation directional signal is minimal, whereas the useful signal component is particularly high in the most complementary gain directional signal possible. Thus, the directional signals generated in the context of the method are advantageously used in a further signal processing process, which is often used in hearing devices.

It has also proven advantageous that an omnidirectional signal is added in a frequency-dependent fashion for generating the output signal. The adding of this signal may, in particular, be a simple linear combination with frequency-dependent linear factors. A person's spatial auditory perception has a significant frequency dependence. Adding an omnidirectional signal with respect to frequency band makes it possible to take into account this frequency dependence in a particularly straightforward way, in particular with those bands in which there is usually a lower angular dependence of auditory sensitivity being correctly reproduced.

With the objects of the invention in view, there is also provided a hearing device having a first input transducer for generating a first input signal, a second input transducer for generating a second input signal, and a signal processing unit and output transducer for generating an output sound signal from an output signal, wherein the signal processing unit is adapted to generate the output signal with reference to the first input signal and the second input signal by a method according to the invention. The advantages mentioned for the method and developments thereof may then be transferred analogously to the hearing device.

With the objects of the invention in view, there is concomitantly provided a bilateral hearing device system with two hearing devices of this kind, and in particular a binaural hearing device system in which the two hearing devices of the hearing device system each transmit signal components to improve the spatial hearing impression.

Other features which are considered as characteristic for the invention are set forth in the appended claims.

Although the invention is illustrated and described herein as embodied in a method for operating a hearing device, a hearing device and a binaural hearing device system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SINGLE VIEW OF THE DRAWING

The FIGURE is a schematic and block diagram illustrating a hearing device and a method for operating the hearing device to provide the most realistic auditory perception possible.

DETAILED DESCRIPTION OF THE INVENTION

Referring now in detail to the single FIGURE of the drawing, there is seen a schematic and block diagram illustrating a method 2 for operating a hearing device 4. The hearing device 4 has a first input transducer 6 and a second input transducer 8, which generate a first input signal 12 and second input signal 14 from a sound signal 10 of the environment. In the present case, the first input transducer 6 and second input transducer 8 are each formed as omnidirectional microphones. In a preprocessing step 16, a first directional signal 18 and second directional signal 20 are generated as intermediate signals from the first input signal 12 and second input signal 14. The first directional signal 18 has a directivity 22 given by a cardioid having a preferred direction 24 along an axis 25 formed by the two input transducers 6, 8. The second directional signal 20 has a directivity 26 complementary to the first directional signal 18, and therefore has an anti-cardioid shape with respect to the axis 25 connecting the first input transducer 6 and the second input transducer 8.

An attenuation directional signal 28 is formed from the first directional signal 18 and the second directional signal 20. For this purpose, a first angle $\vartheta 1$ is initially externally specified, and this specification may be static or dynamic. A static specification may take place, for example, by putting anatomically (and otherwise) determined angle values in a database, while a dynamic specification may also incorporate the current auditory situation. The attenuation directional signal 28 is initially implemented as a notch filter 30 in the direction of the pre-specified first angle $\vartheta 1$. The notch filter 30 in this case is obtained from a linear superposition of the first directional signal 18 with the second directional signal 20. For this purpose, an angular range $\Delta\vartheta$ is additionally pre-specified, in which the direction of minimum sensitivity of the notch filter 30 may vary by the first angle $\vartheta 1$. The attenuation directional signal 28 is thus given as $$N=R1-a\cdot R2 \text{ (for } \vartheta 2>90°),$$

where N denotes the attenuation directional signal 28 and R1 and R2 denote the first and second directional signals 18, 20, respectively. Finally, a corresponding overlay parameter a for superposition is determined in such a way that the resulting signal level of the attenuation directional signal 28 is minimal over the angular range $\Delta\vartheta$. The direction of minimum sensitivity for the notch filter 30 is thus not necessarily in the direction of the first angle $\vartheta 1$, but in the direction of a second angle $\vartheta 2$ located in the angular range $\Delta\vartheta$ around the first angle $\vartheta 1$. In the event that the second angle $\vartheta 2$ lies in the frontal hemisphere of the user of the hearing device 4, the first directional signal and the second directional signal must also be switched for purposes of the overlay, i.e.

$$N=R2-a\cdot R1 \text{ for } \vartheta 2<90°.$$

A gain directional signal 34 is formed from the first directional signal 18 and the second directional signal 20, with reference to the overlay parameter a or the angle $\vartheta 2$ specified thereby. The gain directional signal 34 has a directivity 36 the sensitivity of which preferably has a local maximum at the second angle $\vartheta 2$, or a local maximum may be found in the angular range $\Delta\vartheta$ around the first angle $\vartheta 1$. The angular range $\Delta\vartheta$ may in this case be formed, for example, by an interval of 20°, i.e. $\vartheta 1+/-10°$.

In this case, the gain directional signal 34 is formed in particular in the direction of the second angle $\vartheta 2$ as a kind of complementary directional signal to the attenuation directional signal 28. While the attenuation directional signal 28 in the form of a notch filter 30 should have as low a sensitivity as possible in the direction of the second angle $\vartheta 2$, the gain directional signal 34 in the direction of the second angle $\vartheta 2$ has the lowest possible attenuation relative to the maximum sensitivity. This may be achieved, for example, by linearly superposing the first directional signal 18 with the second directional signal 20 in the form $$L=R1-b\cdot R2$$

where L denotes the gain directional signal 34 and b is an overlay parameter selected based on the overlay parameter a of the attenuation directional signal 28. If the second angle $\vartheta 2$ lies in the rear hemisphere of the user of the hearing device 4, b is given by −a. If the second angle $\vartheta 2$ is in the frontal hemisphere of the user, then b=a−2. As a result, the directivity 36 of the gain directional signal 34 is varied between a cardioid or anticardioid and an omnidirectional characteristic. The gain directional signal 34 is now subjected to an amplitude compensation 38 that takes into account the different a priori output levels of cardioid-shaped and omnidirectional directivities for identical omnidirectional input signals.

An angled directional signal 40 is generated from the attenuation directivity signal 28 and the gain directional signal 34. In this case, this takes the form $$S=L+c\cdot N$$

where S denotes the angled directional signal 40 and c denotes an overlay parameter that, as its magnitude increases, leads to an increase in directional effect with respect to the second angle $\vartheta 2$. The overlay parameter c may be obtained by minimizing the overall output level of the angled directional signal 40.

The angled directional signal 40 is constructed in such a way that as a result of the component of the gain directional signal 34, there is a particularly high sensitivity in the direction of the second angle $\vartheta 2$, while by using the minimization process, interference from other directions may be suppressed by the attenuation directional signal 28 based on real sound events, without this suppression substantially impacting the contributions of the gain directional signal 32. Constructing the attenuation directional signal 28 by minimizing the total output level over the angular range $\Delta\vartheta$ by the predetermined first angle $\vartheta 1$ also leads to a particularly good adaptation of the attenuation directional signal to the currently-present sound events, within the scope of the specification of the first angle $\vartheta 1$ as the desired preferred direction.

The angled directional signal 40 may now also be subjected to directional noise suppression 42, with the angled directional signal 40 itself being interpreted as a useful signal 44, and the attenuation directional signal 28 being interpreted as a noise component 46. Signal components of an omnidirectional signal, for example the first input signal 12, are added to a signal 48 resulting from the directional noise suppression 42. In this way, an output signal 50 is generated that is converted into an output sound signal 54 by an output transducer 52 of the hearing device 4, which is conveyed to the hearing of the user of the hearing device 4. Due to the component of the angled directional signal 40 in the output signal 50, the output sound signal 54 reproduces the acoustic environment of the hearing device 4 in a particularly realistic manner, because angle-dependent or space-dependent attenuations are modeled on those produced by a real outer ear. The directional effect or attenuation of real hearing may be controlled relative to frequency band by using the component of the omnidirectional first input signal 12 in the output signal 50. In addition, in this case, the signal level of the output signal may still be user-specifically lowered or raised in individual frequency bands.

Although the invention has been illustrated and described in detail by using the preferred embodiment, the invention is not limited by this embodiment. Other variations may be deduced therefrom by a person of ordinary skill in the art, without departing from the protected scope of the invention.

The following is a summary list of reference numerals and the corresponding structure used in the above description of the invention:

LIST OF REFERENCE SIGNS

2 method
4 hearing device
6 first input transducer
8 second input transducer
10 sound signal from the environment
12 first input signal
14 second input signal
16 preprocessing step
18 first directional signal
20 second directional signal
22 directivity
24 preferred direction
25 axis
26 directivity
28 attenuation directional signal

30 notch filter
34 gain directional signal
36 directivity
38 amplitude compensation
40 angled directional signal
42 directional noise suppression
44 useful signal
46 interference component
48 resulting signal
50 output signal
52 output transducer
54 output sound signal
$\vartheta 1$ first angle
$\vartheta 2$ second angle
$\Delta\vartheta$ angular range

The invention claimed is:

1. A method for operating a hearing device, the method comprising the following steps:

using a first input transducer to generate a first input signal from a sound signal;

using a second input transducer to generate a second input signal from the sound signal;

providing a first angle and an angular range; and with respect to frequency bands:

forming an attenuation directional signal based on the first input signal, the second input signal and the first angle, the attenuation directional signal having a relative attenuation at least for a second angle in the angular range about the first angle for setting an overlay parameter, and forming the attenuation directional signal from a first directional signal and a second directional signal as intermediate signals based on the first input signal and second input signal by minimizing a signal level over the angular range around the first angle in order to form the attenuation directional signal, forming a gain directional signal based on the first input signal and the second input signal as well as at least one of the overlay parameter or the second angle having a relative gain for the second angle, generating an angled directional signal from the attenuation directional signal and the gain directional signal, and generating an output signal based on the angled directional signal.

2. The method according to claim 1, which further comprises at least one of:

forming the attenuation directional signal from the first directional signal and the second directional signal based on the first angle and the angular range, or forming the gain directional signal from the first directional signal and the second directional signal based on at least one of the overlay parameter or the second angle.

3. The method according to claim 1, which further comprises forming a notch filter directional signal as the attenuation directional signal.

4. The method according to claim 1, which further comprises forming the angled directional signal by overlaying the attenuation directional signal and the gain directional signal.

5. The method according to claim 4, which further comprises minimizing a signal level to generate the angled directional signal.

6. The method according to claim 1, which further comprises:

performing a directional noise suppression for generating the output signal; and specifying the angled directional signal as a useful signal and specifying the attenuation directional signal as an interference signal.

7. The method according to claim 1, which further comprises adding an omnidirectional signal in a frequency-dependent manner for generating the output signal.

8. A hearing device, comprising:

a first input transducer for generating a first input signal;

a second input transducer for generating a second input signal; and a signal processing unit and an output transducer for generating an output sound signal from an output signal;

said signal processing unit being adapted to generate the output signal with reference to the first input signal and the second input signal by:

providing a first angle and an angular range; and with respect to frequency bands:

forming an attenuation directional signal based on the first input signal, the second input signal and the first angle, the attenuation directional signal having a relative attenuation at least for a second angle in the angular range about the first angle for setting an overlay parameter, and forming the attenuation directional signal from a first directional signal and a second directional signal as intermediate signals based on the first input signal and second input signal by minimizing a signal level over the angular range around the first angle in order to form the attenuation directional signal, forming a gain directional signal based on the first input signal and the second input signal as well as at least one of the overlay parameter or the second angle having a relative gain for the second angle, generating an angled directional signal from the attenuation directional signal and the gain directional signal, and generating an output signal based on the angled directional signal.

9. A binaural hearing device system, comprising two hearing devices according to claim 8.

* * * * *